United States Patent [19]

Wheeler

[11] 4,084,352

[45] Apr. 18, 1978

[54] LAPIDARY MACHINE

[76] Inventor: Bradford J. Wheeler, P.O. Box 629, Lemmon, S. Dak. 57638

[21] Appl. No.: 773,151

[22] Filed: Mar. 1, 1977

[51] Int. Cl.[2] ..... B24B 17/02

[52] U.S. Cl. ..... 51/127; 51/216 LP; 51/229

[58] Field of Search ..... 51/127, 101 R, 101 LG, 51/229, 216 LP, 237 R, 123; 125/30; 279/1 G, 4, 51, 52, 53

[56] References Cited

U.S. PATENT DOCUMENTS

| | | | |
|---|---|---|---|
| 1,998,642 | 4/1935 | Smith | 51/229 |
| 2,413,678 | 1/1947 | Beverlin | 279/4 X |
| 2,450,742 | 10/1948 | Stevens | 51/229 |
| 3,520,091 | 7/1970 | Raphael | 51/101 LG |
| 3,673,742 | 7/1972 | Colbauga | 51/127 X |
| 3,834,085 | 9/1974 | Moeller | 51/127 |
| 3,844,070 | 10/1974 | Reed | 51/127 |

*Primary Examiner*—Harold D. Whitehead
*Assistant Examiner*—Nicholas P. Godici
*Attorney, Agent, or Firm*—Clarence A. O'Brien; Harvey B. Jacobson

[57] ABSTRACT

A lapidary machine having a fluid-actuated chuck arranged for facilitating insertion into and removal from the chuck of a dopstick provided with a shank of substantially square cross section. By this arrangement, dopsticks can be easily changed and quickly indexed relative to the associated guide in order to decrease set-up time of the machine while assuring proper orientation of a gemstone with respect to the guide. The machine is also provided with a dashpot connected to the frame of the device and to the chuck, which is mounted for swinging movement of the frame, for preventing rapid movement of the chuck relative to an associated grinding wheel which could damage a stone being profiled.

1 Claim, 4 Drawing Figures

LAPIDARY MACHINE

BACKGROUND OF THE INVENTION

1. Field of the Invention

This invention relates generally to lapidary machines, and particularly to semi-automatic machines which can be used to efficiently and accurately cut the profile of a gemstone that has been sliced and roughly cut to the desired profile. 2. Description of the Prior Art Conventional lapidary machines while well suited for their primary purpose of profiling gemstones, are generally not suited for mass production operations. Accordingly, a substantial amount of labor is required to change dopsticks in the chuck of the machine. Not only is a great deal of time consumed in operating the conventional drill-type chuck commonly employed with lapidary machines, but even more time is lost by the need to visually align the dopstick and stone with the stone guide of the machine. Further, the usual work holders effectively prevent a dopstick supporting a stone finished on one lapidary machine to be transferred to another lapidary machine in order to dome the top of the stone.

Another problem commonly encountered with conventional lapidary machines is that the grinding wheel and stone are occasionally damaged by rapid movement of the chuck holding the dopstick supporting the stone relative to a grinding wheel of the machine such that the stone strikes the wheel.

U.S. Pat. No. 3,673,742, issued July 4, 1972 to S. A. Colbaugh, discloses a lapidary machine particularly adapted for producing cabochon shaped gemstones and including a swinging chuck arrangement which cooperates with a slide-mounted guide wheel and an annular grinding surface disposed perpendicularly to the extent of the stone carrying dopstick and associated chuck. Further, U.S. Pat. No. 1,998,642, issued Apr. 23, 1935 to E. C. Smith discloses a stone shaping device with a slidably mounted, manually orientable dopstick holder, while U.S. Pat. No. 3,568,369, issued Mar. 9, 1971 to E. G. Marshall, discloses another example of a gem grinding machine wherein the work holder swings toward and away from the grinding wheel of the device.

SUMMARY OF THE INVENTION

It is an object of the present invention to provide a lapidary machine capable of clamping a dopstick each time with the same relationship to a stone guide.

It is another object of the present invention to provide a lapidary machine capable of using the entire face of a conventional diamond wheel and the like.

It is yet another object of the present invention to provide a lapidary machine permitting indexing of a dopstick in the chuck of the machine for permitting a stone finished on one machine to be transferred to another machine to, for example, dome the top of the stone.

It is a still further object of the present invention to provide a lapidary machine which permits damped handling of the swinging chuck of the machine in order to prevent damage to a grinding wheel and stone by a rapid movement of the stone against the grinding wheel.

These and other objects of the invention are achieved by providing a lapidary machine having: a supporting frame, a grinding wheel assembly and a guide wheel assembly both mounted on the frame, and a chuck assembly mounted on the frame of movement relative to the frame and the grinding wheel assembly and guide wheel assembly. The chuck assembly includes a fluid-actuated chuck for retaining a dopstick in the chuck for efficient insertion and removal, and advantageously includes a collet provided with a square hole for receiving a shank of a dopstick which itself has a square cross section so as to be inserted into the hole provided in the collet in one of only four possible positions.

The fluid-actuated chuck also includes a nose cap having front and rear openings and a passage extending between the openings, with the passage decreasing in diameter toward the front of the openings. The collet is slidably disposed within the passage of the nose cap so as to bring a tapered end portion of the collet into clamping engagement with the decreased diameter area of the passage adjacent the front of the openings provided in the nose cap. A push rod is connected to the collet so as to extend away from the rear of the openings of the nose cone, and extends into a cylinder connected to a source of fluid under pressure. A piston connected to the push rod and disposed within the cylinder is normally biased away from the collet, with the fluid under pressure moving the piston toward the collet and moving the collet toward the front of the openings of the nose cap in order to retain the dopstick shank in the hole provided in the collet. Longitudinally extending slots are formed in the tapered end of the collet for assuring a good clamping action of the collet on the dopstick.

The chuck assembly further includes a dashpot pivotally connected to and arranged extending between the frame and the fluid-actuated chuck for preventing rapid movement of the chuck assembly relative to the grinding wheel assembly which could damage the grinding wheel as well as a stone being profiled.

The frame advantageously includes a slide arrangement for permitting the chuck assembly to be reciprocated relative to a face of a grinding wheel of the grinding wheel assembly so as to permit utilization of the entire face of the wheel for shaping stones and affording maximum use of a given wheel.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
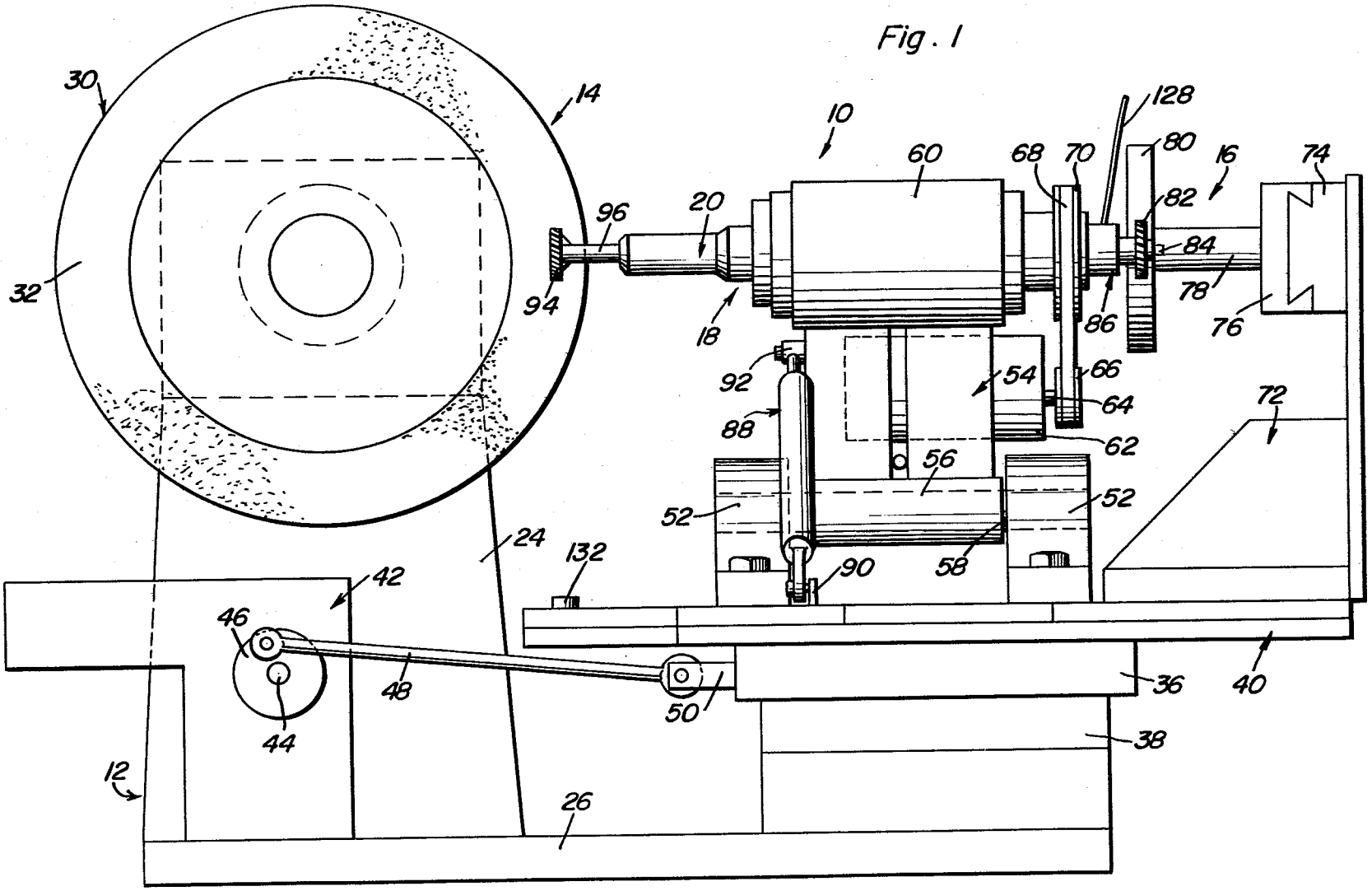
FIG. 1 is a schematic, front elevational view showing a lapidary machine according to the present invention.
Figure 2:
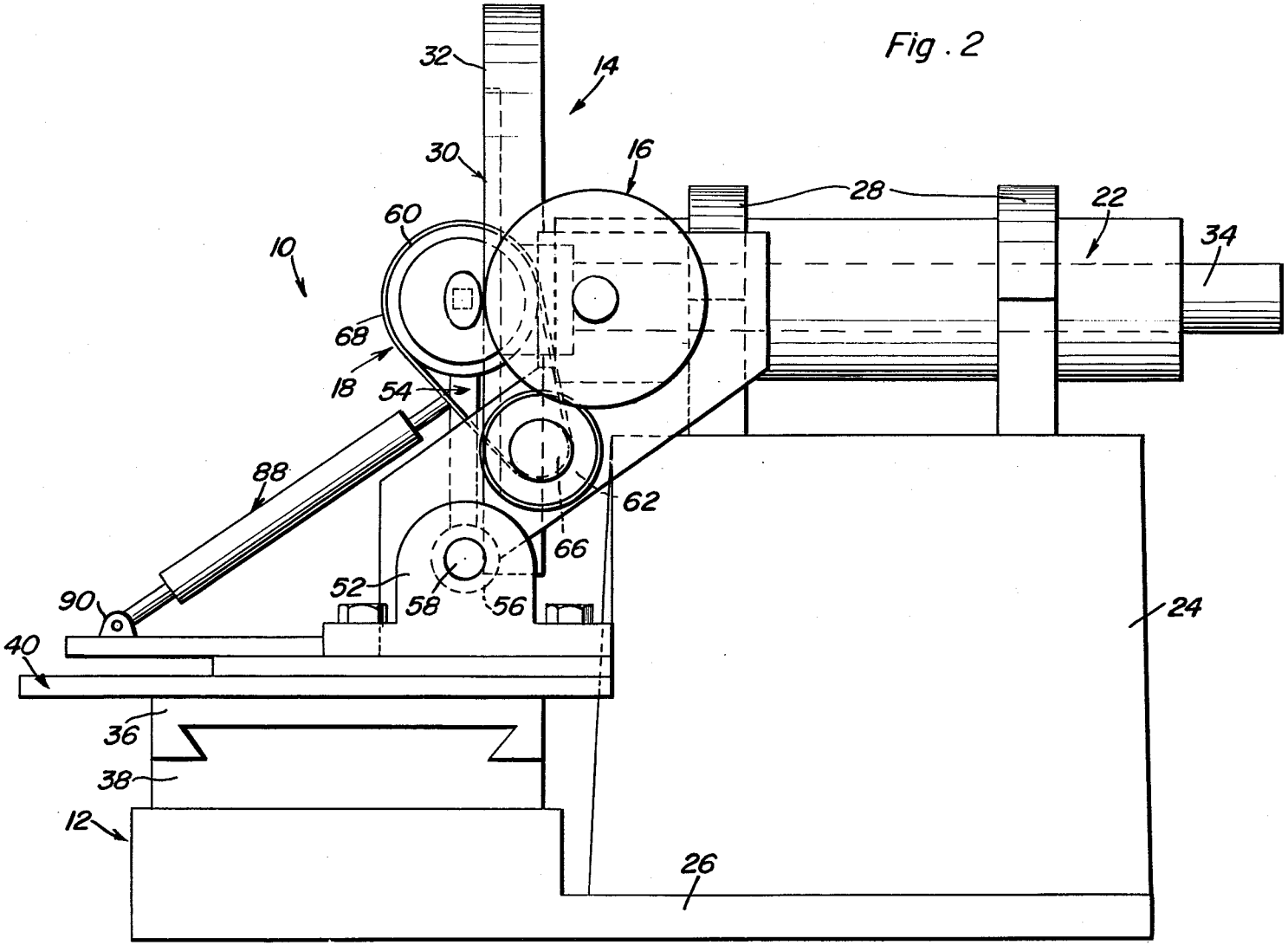
FIG. 2 is a schematic, side elevational view looking from the right in FIG. 1.

Referring now more particularly to FIGS. 1 and 2 of the drawings, a lapidary machine 10 according to the invention includes a supporting frame 12, a grinding wheel assembly 14 and a guide wheel assembly 16 both mounted on frame 12, and a chuck assembly 18 mounted on frame 12 for movement relative to frame 12 and the grinding wheel assembly 14 and guide wheel assembly 16. This chuck assembly 18 includes a fluid-actuated chuck 20 according to the invention retaining a stone-carrying dopstick in such a manner as to permit quick changes of dopsticks and eliminating the need to visually align the dopstick and stone with a stone guide of chuck assembly 18.

Grinding wheel assembly 14 includes an arbor 22 journaled on a pedestal 24 extending from base 26 of frame 12. Arbor 22 is journaled internally by conventional bearings (not shown), and rigidly connected to pedestal 24 by mounts 28, and has mounted on one end thereof a, for example, diamond wheel 30 which includes a grinding face 32. The other end of arbor 22 terminates in a shaft 34 which can be connected to a suitable motor (not shown) and associated mechanism for rotating wheel 30.

Frame 12 includes a slide 36, which may be of conventional dove-tail construction, which cooperates with a guide 38 and supports a platform arrangement 40 to reciprocate chuck assembly 18, which is mounted on platform arrangement 40, relative to face 32 of wheel 30 and permit the use of the entire width of face 32 for shaping stones on machine 10.

Slide 36 is reciprocated by an arrangement including a motor 42 which includes a suitable gear train for rotating a shaft 44 on which a wheel 46 is affixed. Pivotally connected to wheel 46 is a link 48 which is also pivotally connected to an ear 50 extending from slide 36. By this arrangement, rotation of wheel 46 will cause reciprocal movement of link 48 so as to cause the desired reciprocating movement of slide 36 relative to guide 38, which is mounted on base 26 of frame 12.

Mounted on the upper surface of the composite platform arrangement 40 are a pair of pillow blocks 52 rotatably mounting a support 54 of chuck assembly 18. More specifically, a sleeve 56 disposed at the lower end of support 54 receives a shaft 58 for rotation thereby, which shaft 58 is journaled in pillow blocks 52. Further, a collar 60 disposed at the upper end of support 54 receives the fluid-actuated chuck 20 for retaining chuck 20 relative to platform arrangement 40. In this manner, the chuck 20 is permitted to swing in a direction perpendicular to the plane of face 32 of grinding wheel 30.

Chuck 20 is rotated as by a conventional motor 62 suitably mounted on support 54 and having an output shaft 64 on which is mounted a pulley 66 for rotation with shaft 64. A belt 68 wrapped around pulley 66 also extends around a pulley 70 mounted on chuck 20 for rotating both chuck 20 and a dopstick mounted on chuck 20 in order to profile a stone supported by the dopstick.

Guide wheel assembly 16 includes a generally upstanding angle bracket 72 on which is mounted a guide 74 which supports a slide 76. Guide 74 and slide 76 may be of the illustrated dove-tail construction. Affixed to slide 76 and extending perpendicularly therefrom is a shaft 78 on which is mounted a guide wheel 80 arranged for engagement with a stone guide 82 mounted on a stud 84 of a rear hub 86 of chuck 20, and retained as by the illustrated conventional nut. Wheel 80 is disposed in a common plane with stone guide 82 such that guide 82 will contact wheel 80 whenever a stone being shaped has been ground to be common profile with the associated portion of the stone guide 82.

Chuck assembly 18 includes a dashpot 88 similar in construction to a conventional shock absorber and pivotally connected to and arranged extending between frame 12 and chuck 20 for preventing any rapid movement of chuck 20 relative to wheel 30 which could damage the grinding wheel as well as a stone being profiled. Dashpot 88 is mounted as by a lug 90 to frame 12 and by a pin 92 to chuck assembly 18, and advantageously is provided with a slip joint (not shown) which allows free movement of chuck assembly 18 for short distances when a stone 94 mounted on a dopstick 96 is being cut. Dashpot 88 is engaged when making large movements of chuck assembly 18, however, such as when pivoting assembly 18 out of cutting position when changing finished stones to unfinished stones and subsequently when moving chuck assembly 18 back to the illustrated cutting position.

Figure 3:
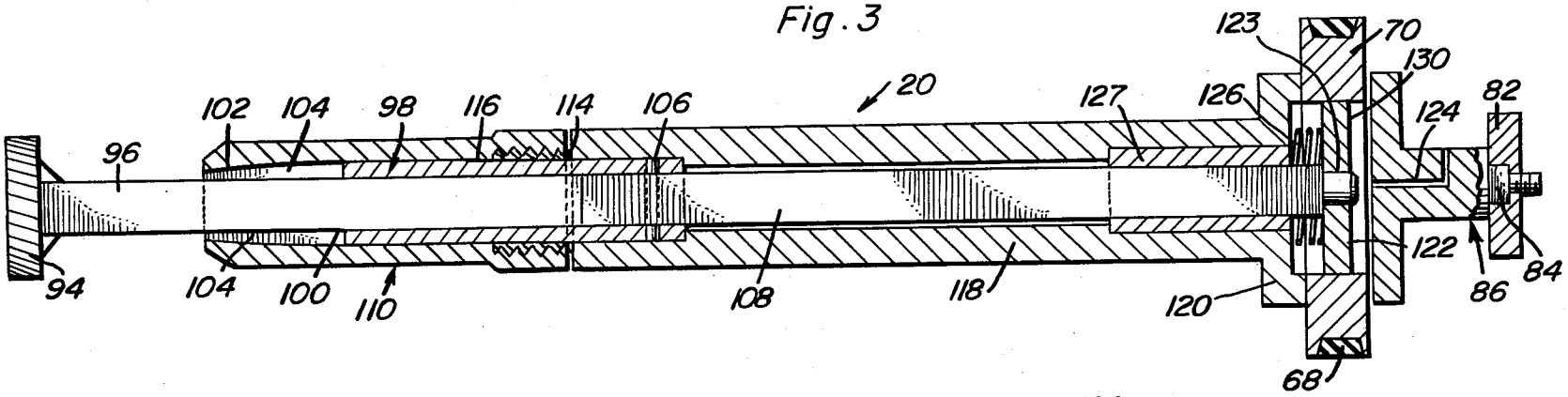
FIG. 3 is a vertical longitudinal sectional view showing a fluid-actuated chuck according to the present invention.
Figure 4:
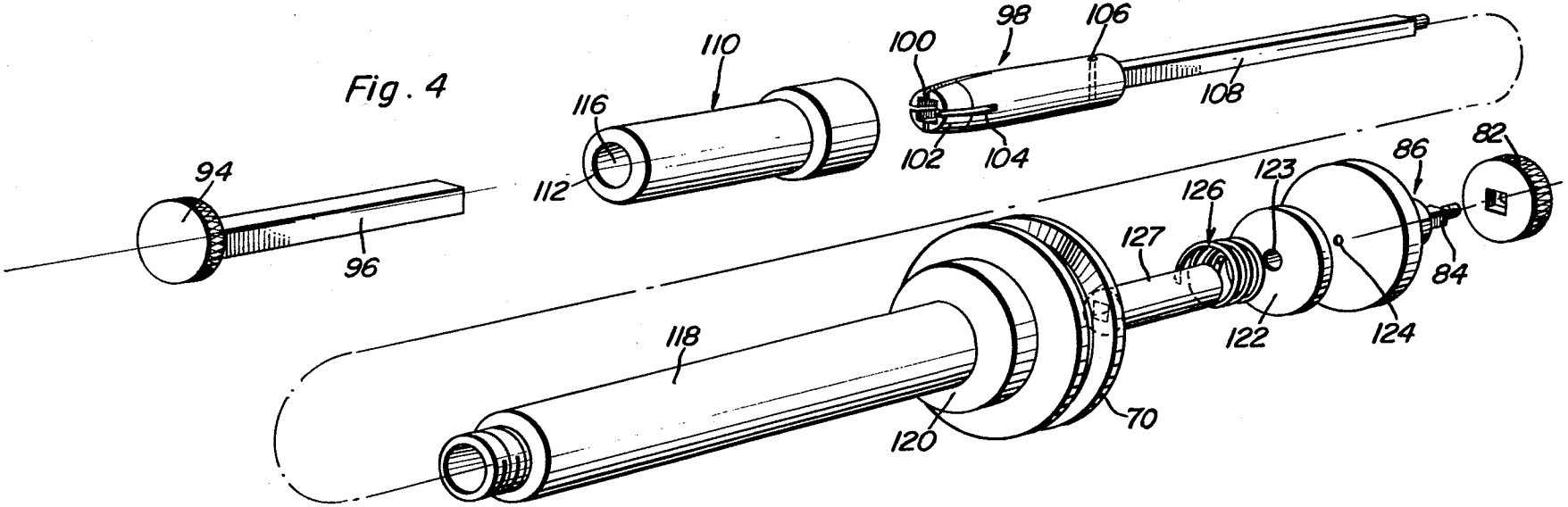
FIG. 4 is an exploded perspective view showing the chuck of FIG. 3.

Referring now more particularly to FIGS. 3 and 4 of the drawings, chuck 20 includes a collet 98 provided with a square hole 100 for receiving a dopstick 96 having a substantially square cross section in one of only four possible positions. By this arrangement, proper orientation of a partially finished stone relative to stone guide 82 can be made without the need of visual alignment of the stone 94 with the stone guide 82. Collet 98 is provided with a tapered nose 102 provided with a plurality of longitudinally extending slots 104 arranged for permitting collet 98 to securely clamp dopstick 96 when pressure is applied to nose 102 of collet 98. A pin 106 disposed in suitable apertures connects a push rod 108 to collet 98 in such a manner that push rod 108 extends away from the rear of collet 98. Chuck 20 further includes a nose cap 110 having front and rear openings 112 and 114, respectively, and a passage 116 extending between the openings 112 and 114. Passage 116 decreases in diameter toward front opening 112, with collet 98 being slidably disposed within the passage 116 of nose cap 110 such that the tapered nose 102 of collet 98 is slidably matable with the portion of passage 116 adjacent to opening 112.

Chuck 20 still further includes a tube 118 threadably connectible to the nose cap 110 adjacent rear opening 114 thereof, and terminating in the direction away from nose cap 110 in a generally cup-shaped housing portion 120. The latter cooperates with hub 86 to embrace pulley 70, which is of generally annular construction with a hollow central portion, so as to form a cylinder which slidably receives a piston 122 affixed to the associated longitudinal end of push rod 108 by receiving the cylindrical end of push rod 108 in a hole 123 provided in piston 122. Attachment of piston 122 to push rod 108 is achieved in a suitable manner, such as by soldering or brazing.

A port 124 is formed in hub 86 so as to permit fluid pressure to be exerted on the opposed face of piston 122 and cause piston 112 to be moved to the left as seen in FIG. 3 against the bias of a conventional coiled compression spring 126 inserted between the other of the faces of piston 122 and the inner surface of housing portion 120. Such movement against the bias of spring 126 will cause collet 98 to move toward the front opening 112 of nose cap 110 in order to retain dopstick 96 in hole 100 of collet 98.

A square-holed sleeve 127 is soldered, and the like, into housing 120. The push rod 108 is slidably disposed through the square-holed sleeve 127. Thus, when hub 86 is secured to housing 120, as by machine screws, the square portion of hub 86 is aligned with the square hole in collet 98. Because push rod 108 is slidably disposed by the square-holed sleeve 127, the alignment of 86 and 98 must remain constant. Consequently, it is necessary that the orientation between the square section of hub 86 and the square section of the dopstick 96 be one of alignment.

A hose 128 (FIG. 1) communicates with port 124 by a universal air joint (not shown) in order to selectively supply a suitable fluid, such as air, under pressure to face 130 of piston 122 and cause a clamping action of collet 98 on dopstick 96. Contrarily, release of air pressure from port 124 permits the bias of spring 126 to move collet 98 back to the right as seen in FIG. 3 in order to release dopstick 96. A suitable valve (not shown) may be inserted into the hose 128 in order to selectively achieve the pressurizing and venting of the cylinder in which piston 122 is disposed.

OPERATION

After a stone 94 has been sliced, marked for a desired shape, and rough cut to that shape, usually from 2 to 10 mm. oversized depending on the size of the stone desired, in a conventional manner, the stone 94 is waxed with sealing wax, and the like, on a piece of keystock forming a dopstick 96. In order to assure consistency in stone size of stones with tapered or beveled sides, the dopsticks 96 are all milled to equal lengths, perhaps plus or minus 0.0005. This insures consistent stone sizes regardless of the preselected degree of taper used for any group of stones.

After the stone 94 has been waxed onto dopstick 96, the stone 94 is placed in machine 10 and clamped by applying force to the square-holed collet 98 to drive the tapered nose 100 of collet 98 against the opposite tapered section of nose cap 110 of chuck 20, causing collet 98 to clamp dopstick 96 in place. One should note that dopstick 96 will project from nose cap 110 the same distance every time the stone 94 is clamped. This is essential to assure consistency in stone size.

By using a square-holed collet 98, the dopstick 96 can be placed in the machine 10 only four ways. The placement of dopstick 96 in collet 98 is of no consequence when grinding a round stone; however, when grinding, for example, an oval the dopstick 96 can be placed properly in the collet 98 only two ways. That is, the stone 94 and dopstick 96 must be placed in collet 98 so that the long axis of the oval corresponds to the long axis of stone guide 82. This proper orientation can be accomplished with a simple inspection by the operator (not shown) when placing dopstick 96 in machine 10. This, chuck 20 has a great advantage over a regular drill chuck (not shown) using a shaft for a dopstick, which requires time-consuming inspection by the operation each time the stone and dopstick are clamped into the machine.

After the stone 94 and dopstick 96 are clamped in machine 10, chuck assembly 18 is pivoted to wheel 30 so stone 94 can begin cutting. Motor 62 turns chuck 20 at about 15 rpm, for example, allowing all sides of the stone profile to contact the wheel 30. When the stone 94 reaches its desired size, the stone guide 82 contacts the guide wheel 80 and any further cutting is prohibited. Stone guide 82 has a square hole broached in it which fits the square section of a portion of hub 86 where guide 82 rests. The square section of hub 86 is aligned with the square hole 100 of collet 98 so as to allow a reference for the orientation of the natural axis of a stone with the square cross section of the dopstick 96 when dopping the stone 94 on dopstick 96. The stone guide 82 is held on by the illustrated nut, which can be easily moved to change guides for different stone shapes.

A weight (not shown) can be threaded and held on a threaded shaft (not shown) so as to vary the cutting pressure between the stone and wheel 30.

Dove-tail slide 76 is provided with a fine lead screw adjustment (not shown) so as to make adjustments in the stone size. Stone guide 82 determines the shape of the stone while the position of guide wheel 80 determines the size of the stone. Thus, a $10 \times 8$ oval guide can be used to make an $8 \times 6$ oval simply by adjusting the lead screw which cooperates in a known manner with slide 76.

It should be noted that the platform arrangement 40 that holds chuck assembly 18 and guide wheel assembly 16 pivots about a screw 132 which is placed directly under the contact point of the stone 94 and wheel 30. This insures that when the platform arrangement 40 is rotated to a new position to change the taper of the cut, the guide wheel 80 will not have to be adjusted to obtain the same size stone with the same guide 82.

Machine 10 incorporates a finely constructed arbor 22 using quality ball bearing for journaling same in order to assure that the, for example, diamond wheel 30 rotates on a shaft that is free from play. This finely constructed arbor is necessary to insure consistency in stone size and the use of all the diamond on the diamond wheel. The thickness of the diamond plating of the diamond wheel is about 0.005 inch. Any play in the arbor 22 would not allow even usage of the diamond on the wheel 30. Because these diamond wheels are rather expensive, it is an advantageous feature of the invention that all of the diamond on the wheel is used.

After the stone 94 has finished cutting, the operator pivots the check assembly 18 back from the wheel 30 on its bearing, or pillow blocks 52, releases the air pressure to chuck 20 by the use of an electric solenoid valve (not shown) of conventional construction and actuated by a foot pedal (not shown), and removes the stone 94 from machine 10. Then, the operator places a new dopstick 96 and stone 94 in machine 10, pivots the chuck assembly 18 back so that the stone 94 contacts the face 32 of wheel 30, and the next stone starts cutting.

The dashpot 88 is mounted between the platform arrangement 40 and chuck 20 in order to restrict the free pivoting of chuck assembly 18 and prohibit the operator from slamming the stone 94 against the wheel 30 and either chipping the diamond plating from wheel 30 or knocking the stone 94 off the dopstick 96.

SUMMARY

As can be appreciated from the above description and from the drawings, a lapidary machine according to the invention provides an efficient and reliable device well suited for mass production operations. The fluid-actuated chuck allows an operator to effeciently run more than, for example, ten machines at once, and the fact that the fluid-actuated chuck clamps the dopstick with the same relationship to the guide every time makes multiple step operations feasible.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

I claim:

1. A fluid-actuated chuck, comprising, in combination:

(a) a collet provided with a square hole for receiving a dopstick having a mating square shaft;

(b) a nose cap having front and rear openings and a through passage extending between the openings, the passage decreasing in diameter toward the front of the openings, with the collet being slidably disposed within the passage of the nose cap;

(c) a push rod connected to the collet and extending away from the rear of the opening of the nose cap, a cylinder connected to a source of fluid under pressure and connected to the nose cap, a piston connected to the push rod and normally biased away from the nose cap, the fluid under pressure moving the piston toward the nose cap and moving the collet toward the front of the openings of the nose cap, the collet being provided with a tapered nose including means for increasing the resiliency of the tapered nose and being matably received in the decreasing diameter portion of the passage of the nose cap in order to be clamped against the dopstick and retain the dopstick in the hole provided in the collet;

(d) a hub attached to the cylinder and extending longitudinally away from the collet and nose cap, the hub having a square cross section; and (e) a stone guide provided with a square hole mating with the hub, the stone guide being removably mounted on the hub, with a consistent orientation thus being assured between the stone guide and dopstick.

2. In a lapidary machine including a supporting frame, a grinding wheel assembly and a guide wheel assembly both mounted on the frame, and a chuck assembly mounted on the frame for movement relative to the frame and the grinding wheel and guide wheel assemblies, the improvement wherein the chuck assembly includes a fluid-actuated chuck for retaining a dopstick in the chuck assembly, the fluid-actuated chuck, comprising, in combination:

(a) a collet provided with a square hole for receiving a dopstick having a mating square shaft;

(b) a nose cap having front and rear openings and a through passage extending between the openings, the passage decreasing in diameter toward the front of the openings, with the collet being slidably disposed within the passage of the nose cap for clamping against the dopstick;

(c) a push rod connected to the collet and extending away from the rear of the opening of the nose cap, a cylinder connected to a source of fluid under pressure and connected to the nose cap, a piston connected to the push rod and normally biased away from the nose cap, the fluid under pressure moving the piston toward the nose cap and moving the collet toward the front of the openings of the nose cap;

(d) a hub attached to the cylinder and extending longitudinally away from the collet and nose cap, the hub having a square cross section; and (e) a stone guide provided with a square hole mating with the hub, the stone guide being removably mounted on the hub, with a consistent orientation thus being assured between the stone guide and dopstick.

3. An improvement as defined in claim 2, wherein the collet is provided with a tapered nose for selectively mating with the decreased diameter section of the passage.

4. An improvement as defined in claim 3, wherein the chuck assembly further includes a dashpot pivotally connected to and arranged extending between the frame and the fluid-actuated chuck for preventing a rapid movement of the chuck assembly relative to the grinding wheel assembly which could damage the grinding wheel as well as a stone being profiled.

5. An improvement as defined in claim 4, wherein the frame includes slide means for permitting the chuck assembly to be reciprocated relative to a face of a wheel of the grinding wheel assembly and using the entire face for shaping a stone.

6. An improvement as defined in claim 2, wherein the chuck assembly further includes a dashpot pivotally connected to and arranged extending between the frame and the fluid-actuated chuck for preventing a rapid movement of the chuck assembly relative to the grinding wheel assembly which could damage the grinding wheel as well as a stone being profiled.

7. An improvement as defined in claim 2, wherein the frame includes slide means for permitting the chuck assembly to be reciprocated relative to a face of a wheel of the grinding wheel assembly and using the entire face for shaping a stone.

* * * * *

UNITED STATES PATENT OFFICE
CERTIFICATE OF CORRECTION

PATENT NO. 4,084,352
DATED April 18, 1978
INVENTOR(S) BRADFORD J. WHEELER

It is certified that error appears in the above-identified patent and that said Letters Patent are hereby corrected as shown below:

On the Front Page, Column 2, after the Abstract, delete "1 Claim" and substitute --7 Claims--.

Signed and Sealed this
*Seventeenth* Day of *October 1978*

[SEAL]

*Attest:*

RUTH C. MASON
*Attesting Officer*

DONALD W. BANNER
*Commissioner of Patents and Trademarks*